US005938537A

United States Patent [19]

Liu

[11] Patent Number: 5,938,537

[45] Date of Patent: Aug. 17, 1999

[54] GOLF EXERCISE STAND

[76] Inventor: Rex Liu, 72, Chi-Yun Rd., Pan-Chiao City, Taipei Hsien, Taiwan

[21] Appl. No.: 09/017,381

[22] Filed: Feb. 3, 1998

[51] Int. Cl.[6] ..... A63B 61/36

[52] U.S. Cl. ..... 473/192; 473/151; 473/180

[58] Field of Search ..... 473/150, 151, 473/152, 153, 154, 176, 180, 190–192, 220, 185, 198, 199

[56] References Cited

U.S. PATENT DOCUMENTS

| | | | |
|---|---|---|---|
| 4,761,009 | 8/1988 | Gibree | 473/185 |
| 5,342,053 | 8/1994 | Smith | 473/192 |
| 5,527,041 | 6/1996 | Terry, III et al. | 473/220 |
| 5,776,007 | 7/1998 | Kendall et al. | 473/176 |
| 5,818,036 | 10/1998 | Daly | 473/150 |

*Primary Examiner*—Mark S. Graham
*Attorney, Agent, or Firm*—Alan Kamrath; Oppenheimer Wolff & Donnelly, LLP

[57] ABSTRACT

A golf exercise stand has a main body, two lateral plates, a sensing device, and a flagpole. The main body has a recess hole, a display screen, a groove, two lateral notches, and a rift. The flagpole has a tube inserted in the recess hole, a joint having an L-shaped block and a shaft supporting the L-shaped block, a post receiving an upper portion of the shaft, and the tube having a center hole receiving a lower portion of the shaft. A U-shaped clamp device is disposed on the L-shaped block. The U-shaped clamp device has an inner periphery groove receiving a light-emitting device and a through hole receiving a bolt. A switch is disposed on the light-emitting device. A nut engages with the bolt. Each lateral plate has a clip end engaging with the respective lateral notch, and a positioning device disposed on the lateral plate.

5 Claims, 5 Drawing Sheets

GOLF EXERCISE STAND

BACKGROUND OF THE INVENTION

The present invention relates to a golf exercise stand. More particularly, the present invention relates to a golf exercise stand which occupies a small room.

A conventional golf exercise stand has a spring-type sensing device in order to count the bumping numbers of the golf balls. However, the spring-type sensing device may not sense the bumping forces of the golf balls after a long period of usage. If the bumping forces of the golf balls are not strong enough, the spring-type sensing device will not operate at all. The width of the conventional golf exercise stand is very long, so the conventional golf exercise stand will occupy a large room. If the user often use a large force to hit the golf balls, the conventional golf exercise stand may be moved.

SUMMARY OF THE INVENTION

An object of the present invention is to provide a golf exercise stand which occupies a small room.

Another object of the present invention is to provide a golf exercise stand which will not be moved while receiving a large force.

Another object of the present invention is to provide a light-emitting device which can direct the passway for the user.

Accordingly, a golf exercise stand comprises a main body, two lateral plates disposed on two sides of the main body, a sensing device disposed on a front portion of the main body, and a flagpole disposed on the main body. The main body has a recess hole, a display screen, a groove, two lateral notches, and a rift communicating with the groove. The flagpole has a tube inserted in the recess hole, a joint having an L-shaped block and a shaft supporting the L-shaped block, a post receiving an upper portion of the shaft, and the tube having a center hole receiving a lower portion of the shaft. An L-shaped block is disposed on the shaft. A U-shaped clamp device is disposed on the L-shaped block. The U-shaped clamp device has an inner periphery groove receiving a light-emitting device and a through hole receiving a bolt. A switch is disposed on the light-emitting device. A nut engages with the bolt. Each lateral plate has a clip end engaging with the respective lateral notch, and a positioning device disposed on the lateral plate.

DETAILED DESCRIPTION OF THE INVENTION

Figure 1:
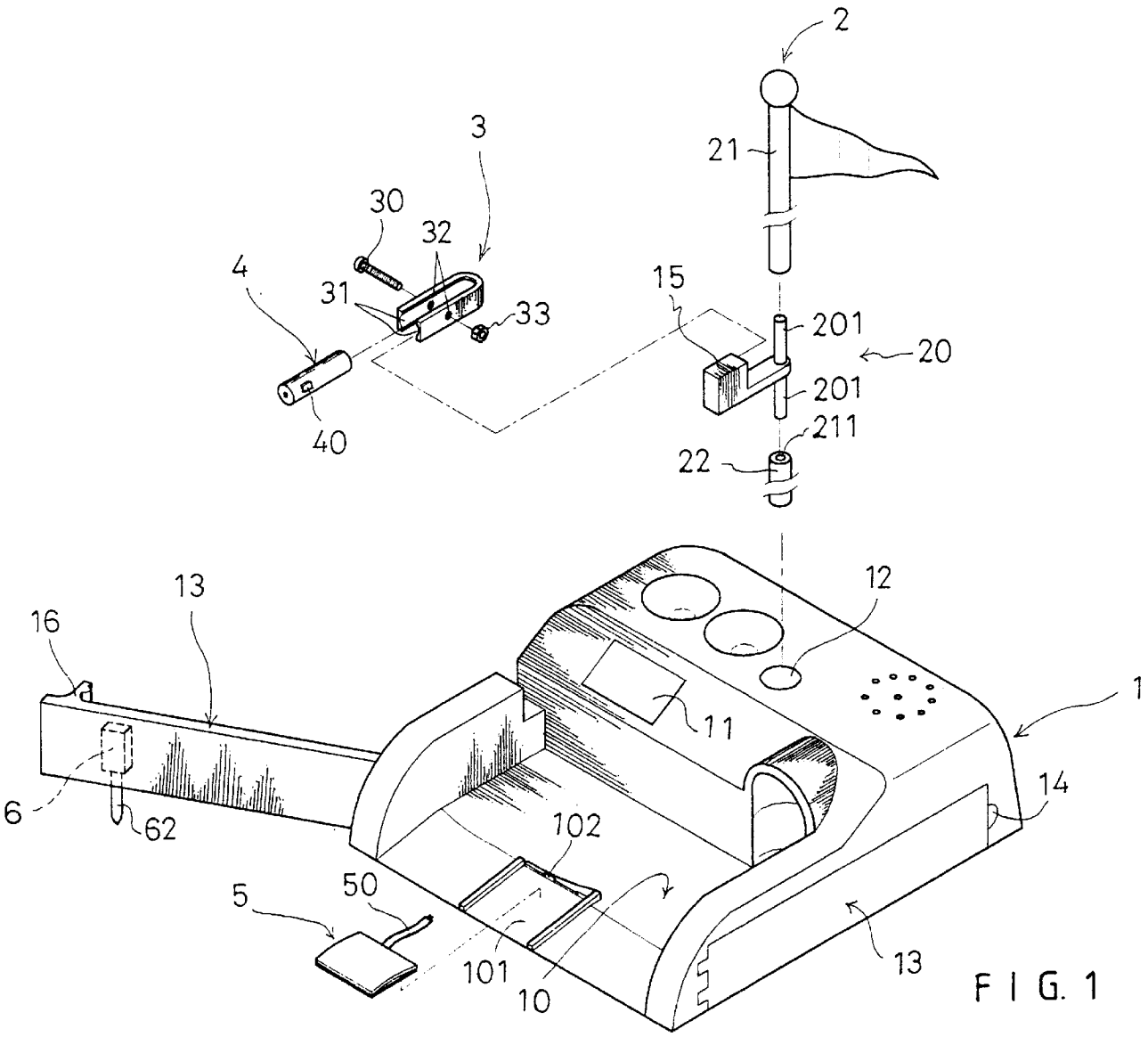
FIG. 1 is a perspective exploded view of a golf exercise stand of a preferred embodiment in accordance with the present invention.
Figure 4:
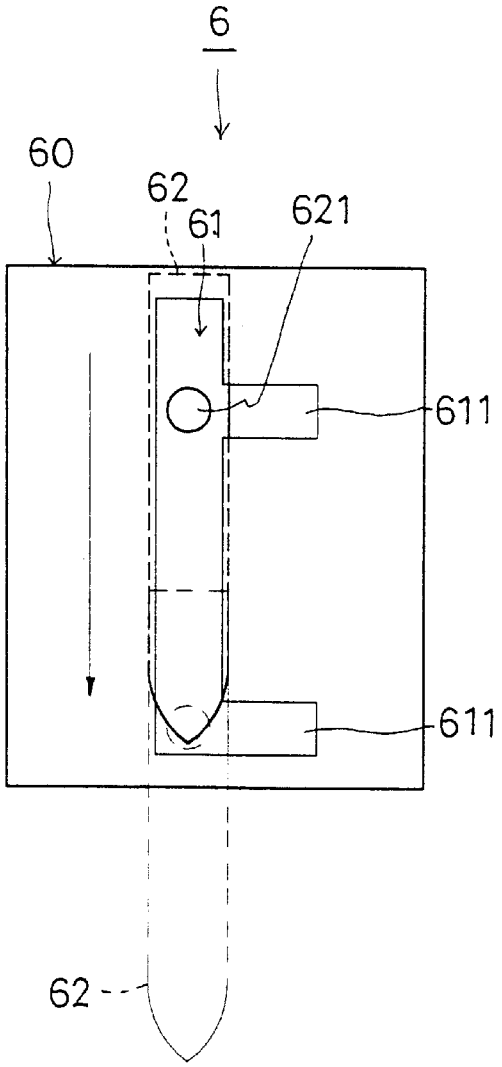
FIG. 4 is a schematic view illustrating an operation of a positioning device of a preferred embodiment in accordance with the present invention.
Figure 3:
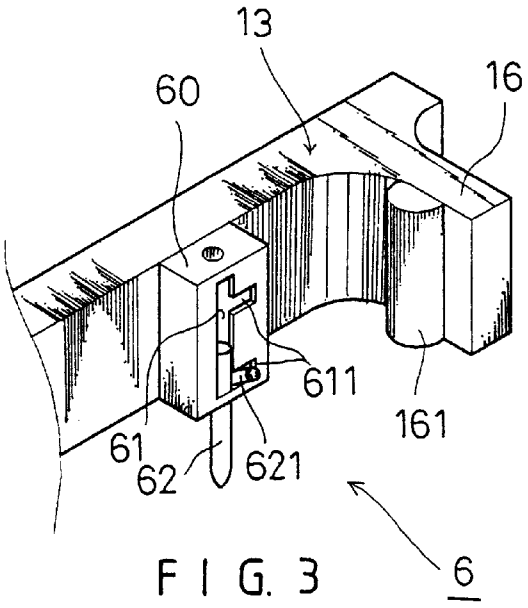
FIG. 3 is a partially perspective view of a positioning device of a prefer-red embodiment in accordance with the present invention.
Figure 2:
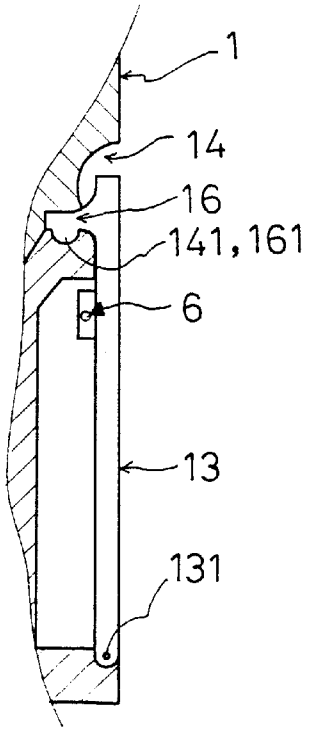
FIG. 2 is a partially sectional view of a lateral plate of a preferred embodiment in accordance with the present invention.
Figure 5:
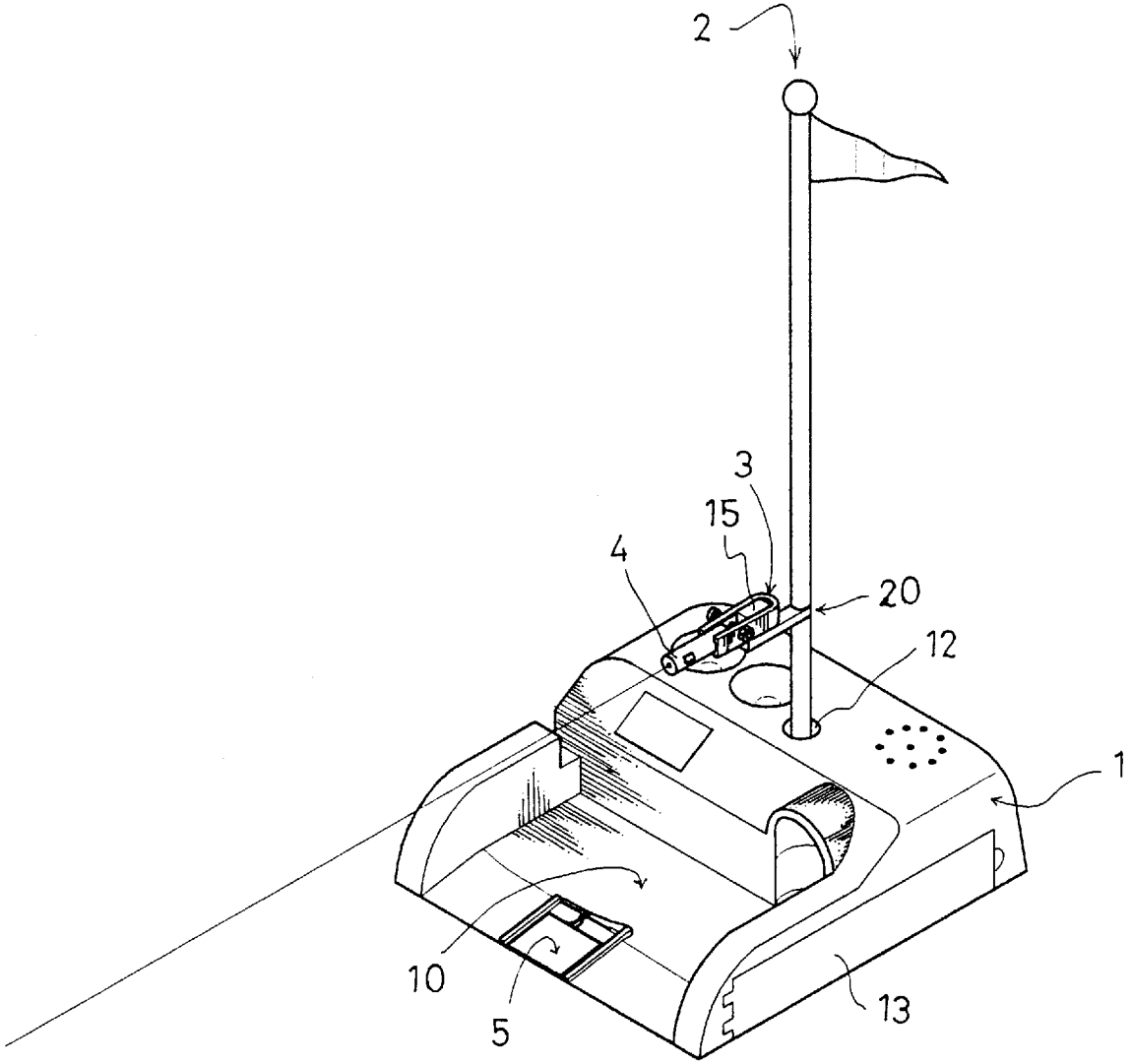
FIG. 5 is a perspective assembly view of a golf exercise stand of a preferred embodiment in accordance with the present invention.
Figure 7:
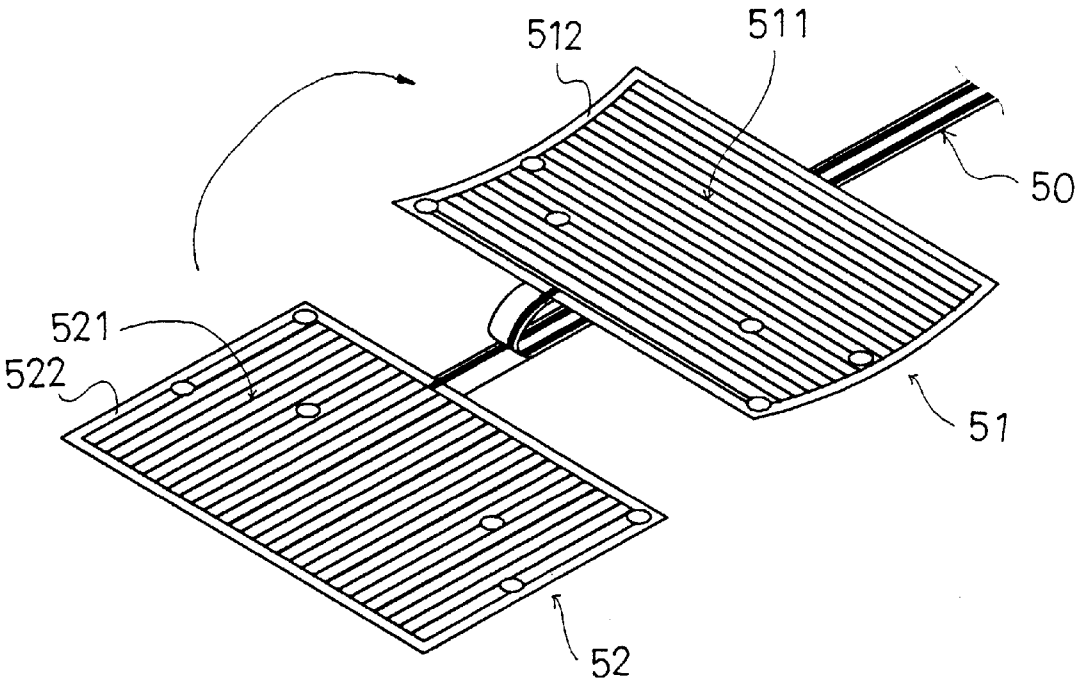
FIG. 7 is a perspective exploded view of a sensing device.
Figure 6:
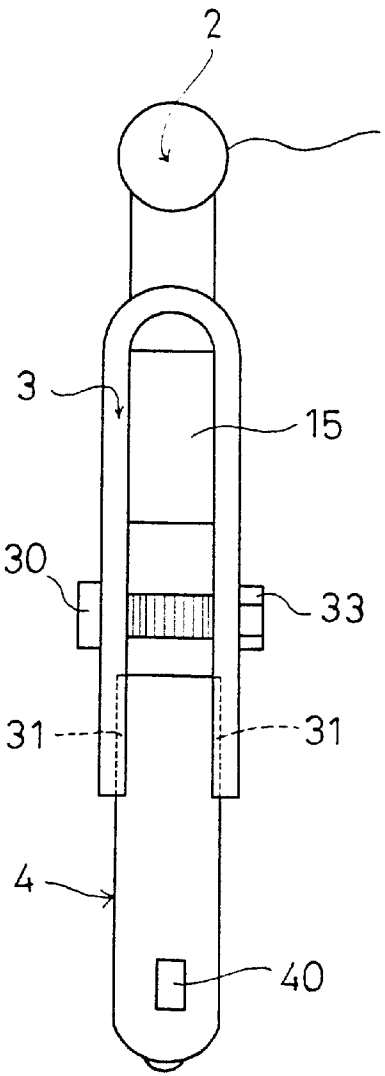
FIG. 6 is an elevational assembly view of a flagpole, a U-shaped clamp device, and a light-emitting device of a preferred embodiment in accordance with the present invention.

Referring to FIGS. 1 to 7, a golf exercise stand comprises a main body 1, two lateral plates 13 disposed on two sides of the main body 1, a sensing device 5 disposed on a front portion of the main body 1, and a flagpole 2 disposed on the main body 1. The main body 1 has a recess hole 12, a display screen 11, a groove 101, two lateral notches 14, and a rift 102 communicating with the groove 101. The flagpole 2 has a tube 22 inserted in the recess hole 12, a joint 20 having an L-shaped block 15 and a shaft 201 supporting the L-shaped block 15, a post 21 receiving an upper portion of the shaft 201, and the tube 22 having a center hole 211 receiving a lower portion of the shaft 201. An L-shaped block 15 is disposed on the shaft 201. A U-shaped clamp device 3 is disposed on the L-shaped block 15. The U-shaped clamp device 3 has an inner periphery groove 31 receiving a light-emitting device 4 and a through hole 32 receiving d bolt 30. A switch 40 is disposed on the light-emitting device 4. A nut 33 engages with the bolt 30 so that the U-shaped clamp device 3 can clamp the light-emitting device 4. Each lateral plate 13 has a clip end 16 engaging with the respective lateral notch 14, and a positioning device 6 disposed on the lateral plate 13. The clip end 16 has a protuberance 161.

The light-emitting device 4 is in a cylinder shape. The sensing device 5 has a wire 50, a first layer 52, and a second layer 51 coupling with the first layer 52. The first layer 52 has a first electrically conductive web 521 and a first adhesive periphery 522. The second layer 51 has a second electrically conductive web 511 and a second adhesive periphery 512. The sensing device 5 can sense the weight of the golf bail. The wire 50 passes through the rift 102.

Figure 8:
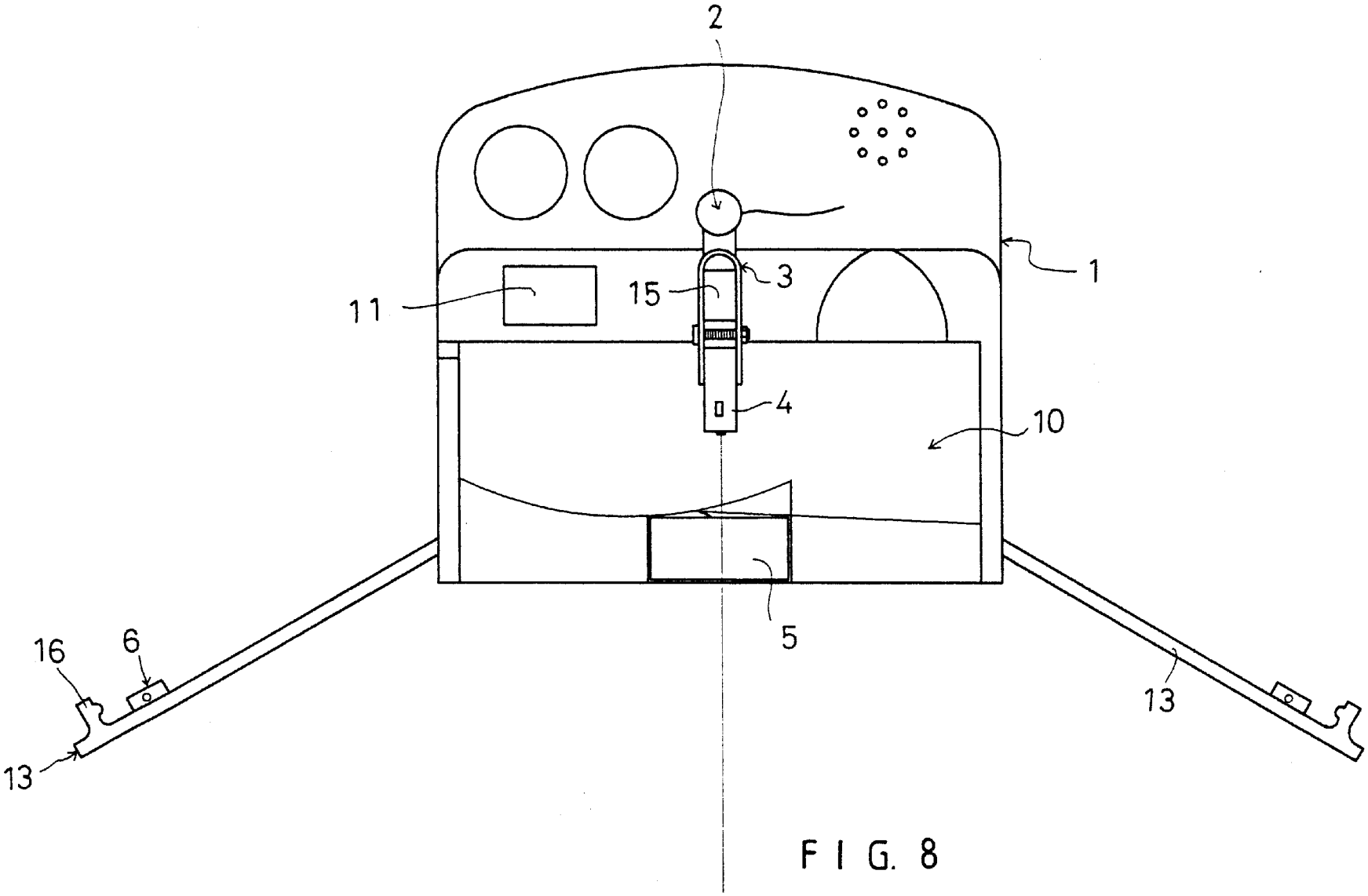
FIG. 8 is a schematic view illustrating that two lateral plates are extended.

The positioning device 6 has a box 60 having two slots 611 and a channel 61 receiving a nail 62, and the nail 62 having a lateral bar 621 inserted it, one of Referring to FIG. 8, the lateral plates 13 can be extended so that the golf ball will be confined in the predetermined range. The nail 62 can be fastened in the ground so that the golf exercise stand can be positioned on the ground stably.

The invention is not limited to the above embodiment but various modification thereof may be made. Further, various changes in form and detail may be made without departing from the scope of the invention.

I claim:

1. A golf exercise stand comprises:

a main body, two lateral plates disposed on two sides of the main body, a sensing device disposed on a front portions of the main body, and a flagpole disposed on the main body, the main body having a recess hole, a display screen, a groove, two lateral notches, and a rift communicating with the groove, the flagpole having a tube inserted in the recess hole, a joint having an L-shaped block arid a shaft supporting the L-shaped block, a post receiving an upper portion of the shaft, and the tube having a center hole receiving a lower portion of the shaft, a U-shaped clamp device disposed on the L-shaped block, the U-shaped clamp device having an inner periphery groove receiving a light-emitting device and a through hole receiving a bolt, a switch disposed on the light-emitting device, a nut engaging with the bolt, each said lateral plate having a clip end engaging with the respective lateral notch, and a positioning device disposed on the lateral plate.

2. A golf exercise stand as claimed in claim 1, wherein the light-emitting device is in a cylinder shape.

3. A golf exercise stand as claimed in claim 1, wherein the positioning device has a box having two slots and a channel receiving a nail, and the nail having a lateral bar.

4. A golf exercise stand as claimed in claim 1, wherein the sensing device has a wife, a first layer, and a second layer coupling with the first layer.

5. A golf exercise stand as claimed in claim 1, wherein the first Layer has a first electrically conductive web and a first adhesive periphery, and the second layer has a second electrically conductive web and a second adhesive periphery.

* * * * *